US007703756B2

(12) United States Patent
Catallo

(10) Patent No.: US 7,703,756 B2
(45) Date of Patent: Apr. 27, 2010

(54) MACHINE FOR CONVERTING A FABRIC FROM A ROLLED FABRIC INTO A SUPERIMPOSINGLY FOLDED FABRIC FOR DELIVERY TO A DYEING MACHINE

(76) Inventor: Frank Catallo, 84 Wheatley Rd., Old Westbury, NY (US) 11568

( * ) Notice: Subject to any disclaimer, the term of this patent is extended or adjusted under 35 U.S.C. 154(b) by 561 days.

(21) Appl. No.: 11/635,915

(22) Filed: Dec. 7, 2006

(65) Prior Publication Data

US 2008/0139373 A1 Jun. 12, 2008

(51) Int. Cl.
*B65H 29/46* (2006.01)

(52) U.S. Cl. ..... 270/30.01; 270/30.04; 270/30.06; 270/30.09; 270/30.11; 270/30.12; 19/163; 493/413; 493/414; 493/415

(58) Field of Classification Search ..... 270/30.01, 270/30.04, 30.06, 30.09, 30.11, 30.12; 19/163; 493/413, 414, 415; 414/791.2
See application file for complete search history.

(56) References Cited

U.S. PATENT DOCUMENTS 2,276,479 A * 3/1942 Gilbert ..... 270/30.04
6,691,544 B2 * 2/2004 Steudle et al. ..... 72/164
6,857,629 B2 * 2/2005 Fritz et al. ..... 270/30.01

* cited by examiner

*Primary Examiner*—Gene Crawford
*Assistant Examiner*—Leslie A Nicholson, III
(74) *Attorney, Agent, or Firm*—Charles E. Baxley

(57) ABSTRACT

A machine for converting a fabric from a rolled fabric into a superimposingly folded fabric for delivery to a dyeing machine. The machine includes a frame, a cradle, and a carriage. The frame rests on an unyielding surface. The cradle is operatively connected to the frame, holds the rolled fabric, and dispenses the fabric from the rolled fabric. The carriage is movably mounted to the frame, and receives the fabric dispensed from the rolled fabric, and in response thereto, moves back and forth relative to the frame to dispense the fabric into the superimposingly folded fabric for delivery to the dyeing machine.

11 Claims, 4 Drawing Sheets

MACHINE FOR CONVERTING A FABRIC FROM A ROLLED FABRIC INTO A SUPERIMPOSINGLY FOLDED FABRIC FOR DELIVERY TO A DYEING MACHINE

BACKGROUND OF THE INVENTION

A. Field of the Invention

The embodiments of the present invention relate to a machine for processing fabric, and more particularly, the embodiments of the present invention relate to a machine for converting a fabric from a rolled fabric into a superimposingly folded fabric for delivery to a dyeing machine.

B. Description of the Prior Art

Knitted fabric from a knitting machine is in roll form. Previously, the rolls averaged approximately 12" in diameter and weighted approximately 35 lbs. Today, they are making rolls approximately 48" in diameter and weighing approximately 500 lbs.

The easiest way to handle the rolls is to roll them on the floor. They, however, have to be unrolled, inspected, and put in trucks in folded form for delivery to the dyeing machines.

Numerous innovations for fabric folders have been provided in the prior art that will be discussed below, which are in chronological order to show advancement in the art, and which are incorporated herein by reference thereto. Even though these innovations may be suitable for the specific individual purposes to which they address, they each differ in structure, and/or operation, and/or purpose from the embodiments of the present invention in that they do not teach a machine for converting a fabric from a rolled fabric into a superimposingly folded fabric for delivery to a dyeing machine.

(1) U.S. Pat. No. 240,390 to Cross et al.

U.S. Pat. No. 240,390 issued to Cross et al. on Apr. 19, 1881 teaches a folding machine including conical folding and feeding rolls arranged and operating to carry along a paper sheet faster at one side than at the other, thereby partially turning the paper sheet, so that when the fold is completed what were the front and rear edges will have become the side edges of the sheet, and apparatus for tucking the paper sheet to be folded into the bite of the rolls.

(2) U.S. Pat. No. 275,154 to Cross.

U.S. Pat. No. 275,154 issued to Cross on Apr. 3, 1883 teaches a machine for folding paper, including endless tapes, rolls for supporting and driving the endless tapes, pin- or brad-armed bars carried by the endless tapes, strippers for disengaging the sheets from the brads, a slotted folding table, and a tucker blade for tucking the sheet down through the slot in the table. These parts are arranged, operated, and timed in their movements relative to one another.

(3) U.S. Pat. No. 2,637,551 to Young.

U.S. Pat. No. 2,637,551 issued to Young on May 5, 1953 in class 270 and subclass 62 teaches an apparatus for folding sheet material, including apparatus for furnishing a continuous web of sheet material, apparatus for reversely folding the material upon itself to form a series of superimposed layers, and oppositely rotating rolls located below the chute in a position to receive the layers thereon and cause outermost portions of each bottom layer to move toward one another into doubled over relationship. The rolls are spaced-apart to provide a guide-way into which successive doubled-over layers of material are advanced in nested relationship to one another.

Apparatus receives the nested layers as they leave the guide-way, and a plurality of nip rolls are arranged to engage opposite sides of the nested material during movement thereof.

(4) U.S. Pat. No. 2,754,113 to Sjostrom.

U.S. Pat. No. 2,754,113 issued to Sjostrom on Jul. 10, 1956 in class 270 and subclass 84 teaches a system for effecting parallel folds of sheet material, including a central plate, side plates, apparatus for feeding the sheet material under the central plate and over the side plates, a holding element having a clamping plate positioned beneath the central plate, electronic apparatus having elements operative on the approach of the sheet being fed and on withdrawal of the sheet being fed to bring the clamping plate against the central plate, pneumatic cylinder and piston apparatus for each of the side plates for moving them inwardly of the central plate and outwardly therefrom, apparatus included in the electronic apparatus operative by the elements for initiating the operation of the pneumatic cylinder and piston apparatus, and switching apparatus also included in the electronic apparatus for establishing a cycle of operation of the pneumatic cylinder and piston apparatus in which the first piston traveling inwards causes the second piston to follow in similar opposed motion after a predetermined time travel.

(5) U.S. Pat. No. 3,752,470 to Buss et al.

U.S. Pat. No. 3,752,470 issued to Buss et al. on Aug. 14, 1973 in class 270 and subclass 80 teaches a sheet-folding machine having an endless belt conveyor for moving a sheet mounted between a pair of spaced end frames. A folder bar is pivotally mounted at the output end of the conveyor belt, and a curved operator bar is mounted below the input end of the conveyor belt so as to be pivotable between start and stop positions. The folder bar is preferably operated by an electric motor drive. A return chute is positioned below the conveyor belt and is adjustably mounted between the end frames. A control system is responsive to the movement of a sheet on the conveyor belt or which is responsive to the operator bar for actuating the folder bar in the proper direction and at the proper time in order to make folds in the sheet.

(6) U.S. Pat. No. 4,060,227 to Landgraf et al.

U.S. Pat. No. 4,060,227 issued to Landgraf et al. on Nov. 29, 1977 in class 270 and subclass 66 teaches a small-piece folder capable of forming both a French fold and cross fold, including a feed belt on which the unfolded articles are initially placed. Adjustable width control blades overlie the feed belt, and the margins of the article are pneumatically blown over the edges of the blades in sequence to form the French fold. The cross fold is also pneumatically initiated at the end of the feed belt.

(7) U.S. Pat. No. 4,573,959 to Baccianti.

U.S. Pat. No. 4,573,959 issued to Baccianti on Mar. 4, 1986 in class 493 and subclass 458 teaches a fabric folding machine including a conveyor belt on which the fabric is held and its motion controlled by suction. A pair of lateral blades are hinged about an axis parallel to a fabric-feed direction for creating longitudinal folds. Transverse folds are produced by comb-like blades hinged perpendicular to the fabric feed direction. Two sets of comb-like blades are provided, which are movable in opposite senses. One of the two sets of comb-like blades can assume two or more positions. The lateral blades can also be adjusted in terms of their distance apart, orthogonal to the fabric feed direction.

(8) U.S. Pat. No. 5,540,647 to Weiermann et al.

U.S. Pat. No. 5,540,647 issued to Weiermann et al. on Jul. 30, 1996 in class 493 and subclass 444 teaches a folding apparatus for automatic folding of flatwork, including a longitudinal folder and a transverse folder following thereafter. In the transverse folder there are two laundry conveyors disposed one behind the other in the conveying direction of a flatwork article arriving from the longitudinal folder. They are spaced-apart by a gap stretching essentially across the entire width of the transverse folder. To make a first transverse fold using a folding blade or air blast, a flatwork article to be transversely folded is led into the gap. Prior to this step, the thickness of the flatwork article to be folded is entered into a data-entry device or is determined using a measuring device. The width of the gap is adjustable, depending upon the particular thickness of the flatwork article. In this manner, optimal conveying along the gap is achieved of a flatwork article having a first transverse fold, independent of thickness. A further laundry conveyor is disposed at the exit end of the gap and the course of its belts located in the area of the gap end can be changed by adjusting an adjustment roller. Following the making of a second transverse fold, the belts can be lowered in the area, by which the flatwork article can reach the output location without having to queue up at a narrow point.

(9) U.S. Pat. No. 6,241,232 to Schmitt et al.

U.S. Pat. No. 6,241,232 issued to Schmitt et al. on Jun. 5, 2001 in class 270 and subclass 30.01 teaches an apparatus for folding a textile fabric length, including at least two transport belts that can be driven in opposite directions, wherein a gap is disposed between the transport belts, through which gap the fabric length can be drawn while forming a fold when the transport belts are driven in opposite directions. In order to achieve greater folding accuracy, a gripping member is disposed above the two transport belts, which member can move substantially parallel to the upper side of the transport belts and can be brought to lie between the front and the back end of the unfolded fabric length with a fixing action.

(10) U.S. Pat. No. 6,899,043 to Muessig et al.

U.S. Pat. No. 6,899,043 issued to Muessig et al. on May 31, 2005 in class 112 and subclass 475.06 teaches a method and a device for cutting and folding a fabric section from a continuous material sheeting for producing multilayer casings, in particular, pillowcases, including a first gripper securing and pulling off the front edge of the material sheeting by a first partial amount. A second gripper secures the material sheeting behind the front edge to form a folded edge, which can be pulled off by a second partial amount, and at the same time, folded together in multiple layers by movement of the second gripper combined with resetting of the first gripper, and a cutting device cuts the material sheeting to form the fabric section, the length of which between the front edge and the rear edge corresponds to the sum of the first and second partial amounts.

It is apparent that numerous innovations for fabric folders have been provided in the prior art that are adapted to be used. Furthermore, even though these innovations may be suitable for the specific individual purposes to which they address, they would not be suitable for the purposes of the embodiments of the present invention as heretofore described, namely, a machine for converting a fabric from a rolled fabric into a superimposingly folded fabric for delivery to a dyeing machine.

SUMMARY OF THE INVENTION

Thus, an object of the embodiments of the present invention is to provide a machine for converting a fabric from a rolled fabric into a superimposingly folded fabric for delivery to a dyeing machine that avoids the disadvantages of the prior art.

Briefly stated, another object of the embodiments of the present invention is to provide a machine for converting a fabric from a rolled fabric into a superimposingly folded fabric for delivery to a dyeing machine. The machine includes a frame, a cradle, and a carriage. The frame rests on an unyielding surface. The cradle is operatively connected to the frame, holds the rolled fabric, and dispenses the fabric from the rolled fabric. The carriage is movably mounted to the frame, and receives the fabric dispensed from the rolled fabric, and in response thereto, moves back and forth relative to the frame to dispense the fabric into the superimposingly folded fabric for delivery to the dyeing machine.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

A. General

Figure 1:
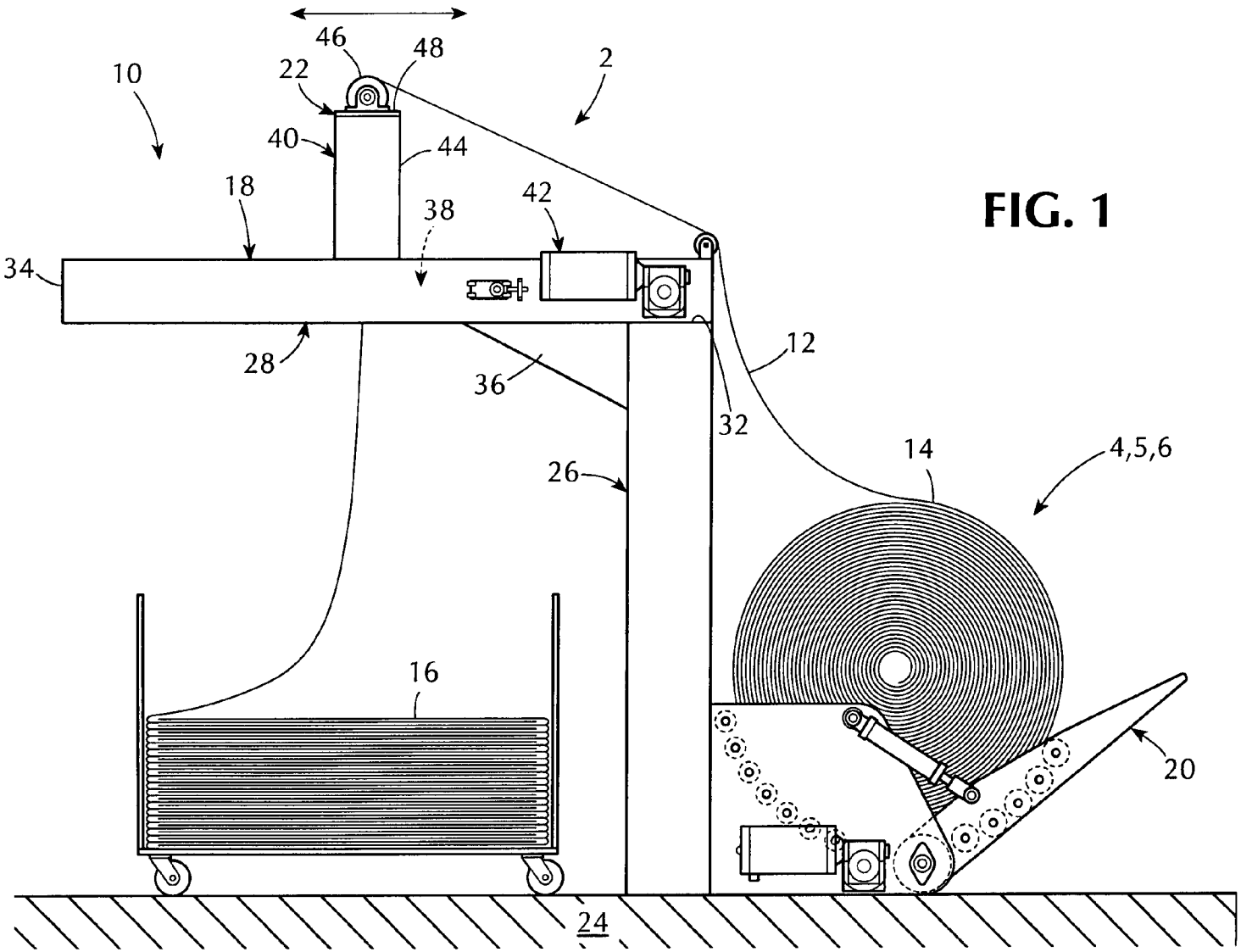
FIG. 1 is a diagrammatic side elevational view of the machine of the embodiments of the present invention converting a fabric from a rolled fabric into a superimposingly folded fabric for delivery to a dyeing machine.

10 machine of embodiments of present invention 10 for converting fabric 12 from rolled fabric 14 into superimposingly folded fabric 16 for delivery to dyeing machine (not shown)

12 fabric

14 rolled fabric

16 superimposingly folded fabric

B. Configuration of Machine 10

18 frame for resting on unyielding surface 24

20 cradle for holding rolled fabric 14 and for dispensing fabric 12 therefrom

22 carriage for receiving fabric 12 dispensed from rolled fabric 14, and in response thereto, moves back and forth relative to frame 18 for dispensing fabric 12 into superimposingly folded fabric 16 for delivery to dyeing machine (not shown)

24 unyielding surface

26 pair of uprights of frame 18 for extending vertically upwardly from unyielding surface 24

28 pair of beams of frame 18

30 cross member of frame 18

32 terminal ends of pair of uprights 26 of frame 18

34 terminal ends of pair of beams 28 of frame 18

36 pair of gussets of frame 18

38 pair of tracks of carriage 22

40 roller assembly of carriage 22 for dispensing fabric 12 received from rolled fabric 14 into superimposingly folded fabric 16 therebelow for delivery to dyeing machine (not shown)

42 first motor of carriage 22

44 pair of stanchions of roller assembly 40 of carriage 22

46 first roller of roller assembly 40 of carriage 22 for receiving fabric 12 dispensed from rolled fabric 14, and in response thereto, dispenses fabric 12 into superimposingly folded fabric 16 therebelow for delivery to dyeing machine (not shown)

48 terminal ends of pair of stanchions 44 of roller assembly 40 of carriage 22

(1) Configuration of Cradle 20.

50 stationary portion of cradle 20 for resting on unyielding surface 24 and for holding rolled fabric 14

52 movable portion of cradle 20, when in open position thereof, is for allowing rolled fabric 14 to be rolled into stationary portion 50 of cradle 20, and when in closed position thereof, is for maintaining rolled fabric 14 in stationary portion 50 of cradle 20

54 plurality of second rollers of stationary portion 50 of cradle 20 for supporting rolled fabric 14 and for rolling in responsive to rolling of rolled fabric 14

56 third roller of stationary portion 50 of cradle 20 for further supporting rolled fabric and for rotating rolled fabric 14

58 second motor of stationary portion 50 of cradle 20

60 plurality of fourth rollers of movable portion 52 of cradle 20 for supporting rolled fabric 14 when movable portion 52 of cradle 20 is in the closed position thereof and for rolling in responsive to rolling of rolled fabric 14

62 hydraulic cylinder of cradle 20

DETAILED DESCRIPTION OF THE PREFERRED EMBODIMENTS

A. General

Referring now to the figures, in which like numerals indicate like parts, and particularly to FIG. 1, which is a diagrammatic side elevational view of the machine of the embodiments of the present invention converting a fabric from a rolled fabric into a superimposingly folded fabric for delivery to a dyeing machine, the machine of the embodiments of the present invention is shown generally at 10 for converting a fabric 12 from a rolled fabric 14 to a superimposingly folded fabric 16 for delivery to a dyeing machine (not shown).

B. The Configuration of the Machine 10

Figure 2:
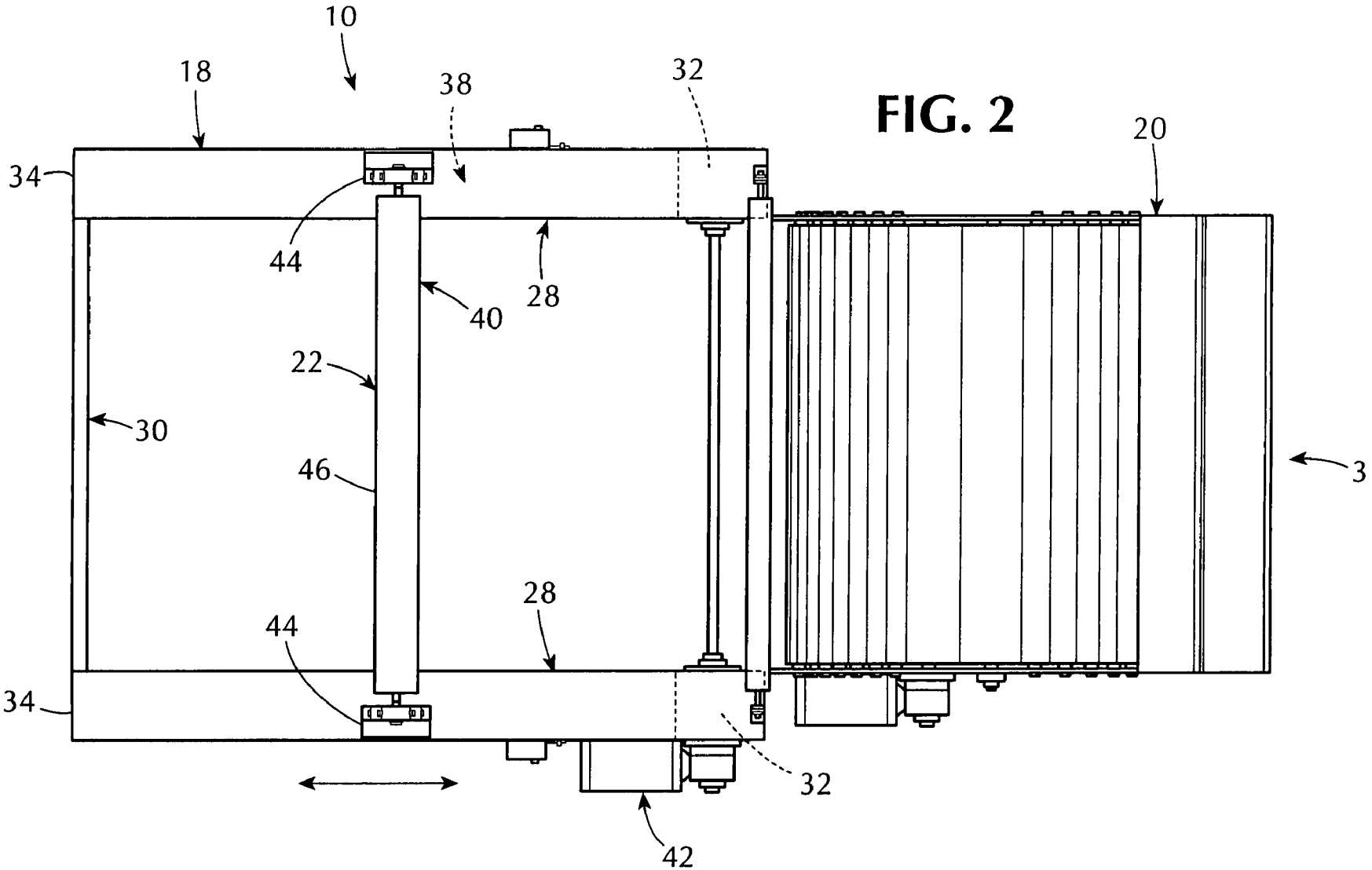
FIG. 2 is a diagrammatic top plan view taken generally in the direction of ARROW 2 in FIG. 1 of the machine of the embodiments of the present invention.
Figure 3:
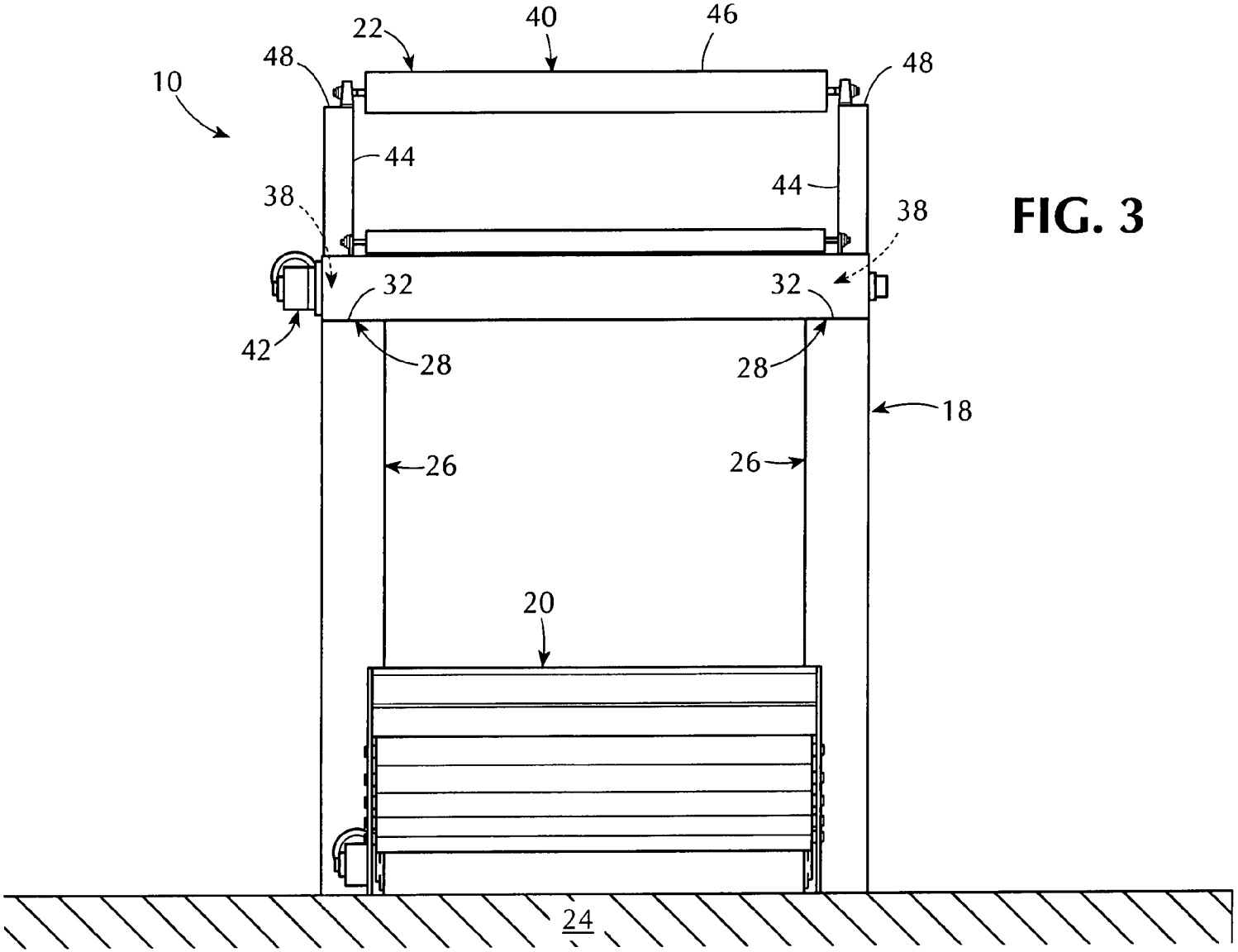
FIG. 3 is a diagrammatic end elevational view taken generally in the direction of ARROW 3 in FIG. 2.

The configuration of the machine 10 can best be seen in FIGS. 1-3, which are, respectively, again a diagrammatic side elevational view of the machine of the embodiments of the present invention converting a fabric from a rolled fabric into a superimposingly folded fabric for delivery to a dyeing machine, a diagrammatic top plan view taken generally in the direction of ARROW 2 in FIG. 1 of the machine of the embodiments of the present invention, and a diagrammatic end elevational view taken generally in the direction of ARROW 3 in FIG. 2, and as such, will be discussed with reference thereto.

The machine 10 comprises a frame 18, a cradle 20, and a carriage 22. The frame 18 is for resting on an unyielding surface 24. The cradle 20 is operatively connected to the frame 16 and is for holding the rolled fabric 14 and for dispensing the fabric 12 therefrom. The carriage 22 is movably mounted to the frame 18 and is for receiving the fabric 12 dispensed from the rolled fabric 14, and in response thereto, moves back and forth relative to the frame 18 for dispensing the fabric 12 into the superimposingly folded fabric 16 for delivery to the dyeing machine (not shown).

The frame 18 comprises a pair of uprights 26, a pair of beams 28, and a cross member 30. The pair of uprights 26 of the frame 18 are parallel to each other, are spaced-apart from each other, and are for extending vertically upwardly from the unyielding surface 24 to terminal ends 32. The pair of beams 28 of the frame 18 are parallel to each other, are spaced-apart from each other, and extend horizontally forwardly from the terminal ends 32 of the pair of uprights 26 of the frame 18, respectively, to terminal ends 34. The cross member 30 of the frame 18 extends transversely across from the terminal end 34 of one beam 28 of the frame 18 to the terminal end 34 of the other beam 28 of the frame 18.

The frame 18 further comprises a pair of gussets 36. The pair of gussets 36 of the frame 18 extend from the pair of uprights 26 of the frame 18 to the pair of beams 28 of the frame 18, respectively, to further support the pair of beams 28 of the frame 18.

The carriage 22 comprises a pair of tracks 38 and a roller assembly 40. The pair of tracks 38 of the carriage 22 extend along the pair of beams 28 of the frame 18. The roller assembly 40 of the carriage 22 is operatively connected to the pair of tracks 38 of the carriage 22 to move back and forth relative to the pair of beams 28 of the frame 18 for dispensing the fabric 12 from the rolled fabric 14 into the superimposingly folded fabric 16 therebelow for delivery to the dyeing machine (not shown).

The carriage 22 further comprises a first motor 42. The first motor 42 of the carriage 22 is operatively connected to the pair of tracks 38 of the carriage 22 to move the roller assembly 40 of the carriage 22 back and forth relative to the pair of beams 28 of the frame 18.

The roller assembly 40 of the carriage 22 comprises a pair of stanchions 44 and a first roller 46. The pair of stanchions 44 of the roller assembly 40 of the carriage 22 are parallel to each other, are spaced-apart from each other, and extend vertically upwardly from operative engagement with the pair of tracks 38 of the carriage 22, respectively, to terminal ends 48. The first roller 46 of the roller assembly 40 of the carriage 22 extends transversely and rotatably across from the terminal end 48 of one stanchion 44 of the roller assembly 40 of the carriage 22 to the terminal end 48 of the other stanchion 44 of the roller assembly 40 of the carriage 22 and is for receiving the fabric 12 dispensed from the rolled fabric 14, and in response thereto, dispenses the fabric 12 into the superimposingly folded fabric 16 therebelow for delivery to the dyeing machine (not shown).

(1) The Configuration of the Cradle 20.

Figure 4:
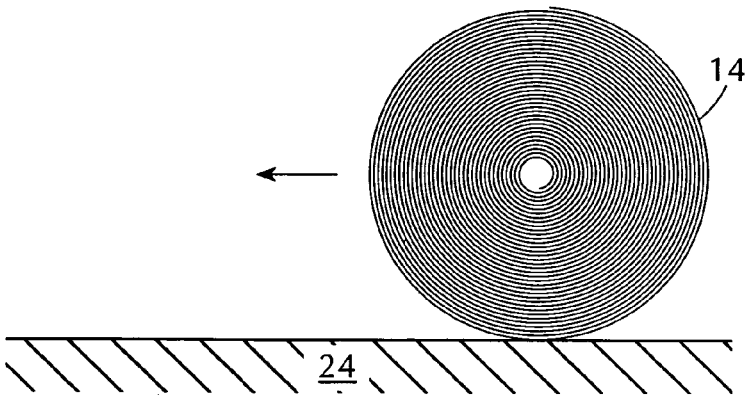
FIG. 4 is a reduced diagrammatic side elevational view of a rolled fabric as identified by ARROW 4 in FIG. 1.
Figure 5:
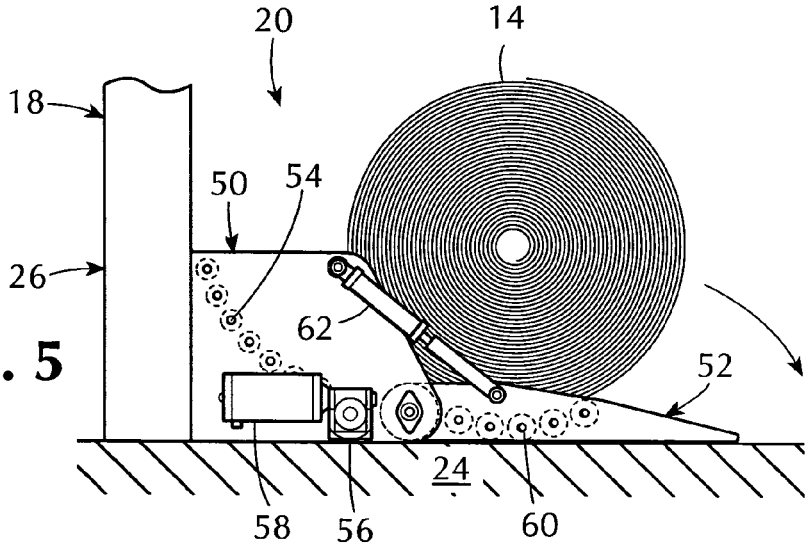
FIG. 5 is a reduced diagrammatic side elevational view of a rolled fabric being loaded into the cradle of the machine of the embodiments of the present invention as identified by ARROW 5 in FIG. 1.
Figure 6:
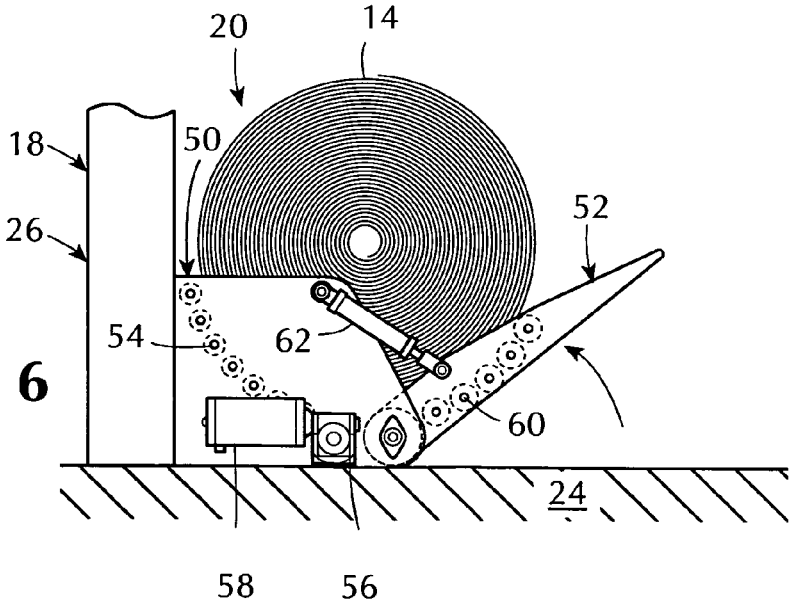
FIG. 6 is a reduced diagrammatic side elevational view of a rolled fabric loaded into the cradle of the machine of the embodiments of the present invention as identified by ARROW 6 in FIG. 1.

The configuration of the cradle 20 can best be seen in FIGS. 4-6, which are, respectively, a reduced diagrammatic side elevational view of a rolled fabric as identified by ARROW 4 in FIG. 1, a reduced diagrammatic side elevational view of a rolled fabric being loaded into the cradle of the machine of the embodiments of the present invention as identified by ARROW 5 in FIG. 1, and a reduced diagrammatic side elevational view of a rolled fabric loaded into the cradle of the machine of the embodiments of the present invention as identified by ARROW 6 in FIG. 1, and as such, will be discussed with reference thereto.

The cradle 20 comprises a stationary portion 50 and a movable portion 52. The stationary portion 50 of the cradle 20 is operatively connected to the frame 18, is for resting on the unyielding surface 24, and is for holding the rolled fabric 14. The movable portion 52 of the cradle 20 is pivotally mounted to the stationary portion 50 of the cradle 20, and when in an open position thereof, is for allowing the rolled fabric 14 to be rolled into the stationary portion 50 of the cradle 20, and when in a closed position thereof, is for maintaining the rolled fabric 14 in the stationary portion 50 of the cradle 20.

The stationary portion 50 of the cradle 20 is affixed to the pair of uprights 26 of the frame 18, while the movable portion 52 of the cradle 20 is pivotal in a direction opposite thereto.

The stationary portion 50 of the cradle 20 comprises a plurality of second rollers 54. The plurality of second rollers 54 of the stationary portion 50 of the cradle 20 are passive, extend transversely thereacross in an concave-arcuate manner, are for supporting the rolled fabric 14, and are for rolling in responsive to rolling of the rolled fabric 14.

The stationary portion 50 of the cradle 20 further comprises a third roller 56. The third roller 56 of the stationary portion 50 of the cradle 20 is active, extends transversely thereacross, is for further supporting the rolled fabric 14, and is for rotating the rolled fabric 14.

The stationary portion 50 of the cradle 20 further comprises a second motor 58. The second motor 58 of the stationary portion 50 of the cradle 20 is operatively connected to the third roller 56 of the stationary portion 50 of the cradle 20 to rotate the third roller 56 of the stationary portion 50 of the cradle 20 for rotating the rolled fabric 14 resting thereon.

The movable portion 52 of the cradle 20 is ramp-like for facilitating rolling the rolled fabric 14 into the stationary portion 50 of the cradle 20.

The movable portion 52 of the cradle 20 comprises a plurality of fourth rollers 60. The plurality of fourth rollers 60 of the movable portion 52 of the cradle 20 are passive, extend transversely thereacross in an concave-arcuate manner, are for supporting the rolled fabric 14 when the movable portion 52 of the cradle 20 is in the closed position thereof, and are for rolling in responsive to rolling of the rolled fabric 14.

The cradle 20 further comprises an hydraulic cylinder 62. The hydraulic cylinder 62 of the cradle 20 is pivotally mounted to both the stationary portion 50 of the cradle 20 and the movable portion 52 of the cradle 20 and pivots the movable portion 52 of the cradle 20 relative to the stationary portion 50 of the cradle 20 to allow the movable portion 52 of the cradle 20 to pivot between the open position thereof and the closed position thereof.

C. Conclusions

It will be understood that each of the elements described above or two or more together may also find a useful application in other types of constructions differing from the types described above.

While the embodiments of the present invention have been illustrated and described as embodied in a machine for converting a fabric from a rolled fabric into a superimposingly folded fabric for delivery to a dyeing machine, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A machine for converting a fabric from a rolled fabric into a superimposingly folded fabric for delivery to a dyeing machine, comprising:

a) a frame;

b) a cradle; and c) a carriage;

wherein said frame is for testing on an unyielding surface;

wherein said cradle is operatively connected to said frame;

wherein said cradle is for holding the rolled fabric;

wherein said cradle is for dispensing the fabric from the rolled fabric;

wherein said carriage is movably mounted to said frame;

wherein said carriage is for receiving the fabric dispensed from the rolled fabric, and in response thereto, moves back and forth relative to said frame for dispensing the fabric into the superimposingly folded fabric for delivery to the dyeing machine;

wherein said frame comprises:

a) a pair of uprights;

b) a pair of beams; and c) a cross member;

wherein said pair of uprights of said frame are parallel to each other;

wherein said pair of uprights of said frame are spaced-apart from each other;

wherein said pair of uprights of said frame are for extending vertically upwardly from the unyielding surface to terminal ends;

wherein said pair of beams of said frame are parallel to each other;

wherein said pair of beams of said frame are spaced-apart from each other;

wherein said pair of beams of said frame extend horizontally forwardly from said terminal ends of said pair of uprights of said frame, respectively, to terminal ends;

wherein said cross member of said frame extends transversely across from said terminal end of one beam of said frame to said terminal end of the other beam of said frame;

wherein said cradle comprises:

a) a stationary portion; and b) a movable portion;

wherein said stationary portion of said cradle is operatively connected to said frame;

wherein said stationary portion of said cradle is for resting on the unyielding surface;

wherein said stationary portion of said cradle is for holding the rolled fabric;

wherein said movable portion of said cradle is pivotally mounted to said stationary portion of said cradle;

wherein said movable portion of said cradle, when in an open position thereof, is for allowing the rolled fabric to be rolled into said stationary portion of said cradle;

wherein said movable portion of said cradle, when in a closed position thereof, is for maintaining the rolled fabric in said stationary portion of said cradle;

wherein said stationary portion of said cradle comprises a third roller;

wherein said third roller of said stationary portion of said cradle is active;

wherein said third roller of said stationary portion of said cradle extends transversely thereacross;

wherein said third roller of said stationary portion of said cradle is for supporting the rolled fabric; and wherein said third roller of said stationary portion of said cradle is for rotating the rolled fabric.

2. The machine of claim 1, wherein said frame comprises a pair of gussets; and wherein said pair of gussets of said frame extend from said pair of uprights of said frame to said pair of beams of said frame to further support said pair of beams of said frame.

3. The machine of claim 1, wherein said carriage comprises:

a) a pair of tracks; and b) a roller assembly;

wherein said pair of tracks of said carriage extend along said pair of beams of said frame; and wherein said roller assembly of said carriage is operatively connected to said pair of tracks of said carriage to move back and forth relative to said pair of beams of said frame for dispensing the fabric received from the rolled fabric into the superimposingly folded fabric therebelow for delivery to the dyeing machine.

4. The machine of claim 3, wherein said carriage comprises a first motor; and wherein said first motor of said carriage is operatively connected to said pair of tracks of said carriage to move said roller assembly of said carriage back and forth relative to said pair of beams of said frame.

5. The machine of claim 3, wherein said roller assembly of said carriage comprises:

a) a pair of stanchions; and b) a first roller;

wherein said pair of stanchions of said roller assembly of said carriage are parallel to each other;

wherein said pair of stanchions of said roller assembly of said carriage are spaced-apart from each other;

wherein said pair of stanchions of said roller assembly of said carriage extend vertically upwardly from operative engagement with said pair of tracks of said carriage, respectively, to terminal ends;

wherein said first roller of said roller assembly of said carriage extends transversely across from said terminal end of one stanchion of said roller assembly of said carriage to said terminal end of the other stanchion of said roller assembly of said carnage;

wherein said first roller of said roller assembly of said carriage extends rotatably across from said terminal end of said one stanchion of said roller assembly of said carriage to said terminal end of said other stanchion of said roller assembly of said carriage; and wherein said first roller of said roller assembly of said carriage is for receiving the fabric dispensed from the rolled fabric, and in response thereto, dispenses the fabric into the superimposingly folded fabric therebelow for delivery to the dyeing machine.

6. The machine of claim 1, wherein said stationary portion of said cradle is affixed to said pair of uprights of said frame, while said movable portion of said cradle is pivotal in a direction opposite thereto.

7. The machine of claim 1, wherein said stationary portion of said cradle comprises a plurality of second rollers;

wherein said plurality of second rollers of said stationary portion of said cradle are passive;

wherein said plurality of second rollers of said stationary portion of said cradle extend transversely thereacross in an concave-arcuate manner;

wherein said plurality of second rollers of said stationary portion of said cradle are for supporting the rolled fabric; and wherein said plurality of second rollers of said stationary portion of said cradle are for rolling in responsive to rolling of the rolled fabric.

8. The machine of claim 1, wherein said stationary portion of said cradle comprises a second motor; and wherein said second motor of said stationary portion of said cradle is operatively connected to said third roller of said stationary portion of said cradle to rotate said third roller of said stationary portion of said cradle for rotating the rolled fabric resting thereon.

9. The machine of claim 1, wherein said movable portion of said cradle is ramp-like for facilitating rolling the rolled fabric into said stationary portion of said cradle.

10. The machine of claim 1, wherein said movable portion of said cradle comprises a plurality of fourth rollers;

wherein said plurality of fourth rollers of said movable portion of said cradle are passive;

wherein said plurality of fourth rollers of said movable portion of said cradle extend transversely thereacross in an concave-arcuate manner;

wherein said plurality of fourth rollers of said movable portion of said cradle are for supporting the rolled fabric when said movable portion of said cradle is in said closed position thereof; and wherein said plurality of fourth rollers of said movable portion of said cradle are for rolling in responsive to rolling of the rolled fabric.

11. The machine in claim 1, wherein said cradle comprises an hydraulic cylinder;

wherein said hydraulic cylinder of said cradle is pivotally mounted to both said stationary portion of said cradle and said movable portion of said cradle; and wherein said hydraulic cylinder of said cradle pivots said movable portion of said cradle relative to said stationary portion of said cradle to allow said movable portion of said cradle to pivot between said open position thereof and said closed position thereof.

* * * * *